United States Patent [19]

Baboian et al.

[11] 4,434,039

[45] Feb. 28, 1984

[54] CORROSION PROTECTION SYSTEM FOR HOT WATER TANKS

[75] Inventors: Robert Baboian, Johnston, R.I.; Gardner S. Haynes, Attleboro, Mass.

[73] Assignee: Texas Instruments Incorporated, Dallas, Tex.

[21] Appl. No.: 450,575

[22] Filed: Dec. 17, 1982

[51] Int. Cl.[3] ..... C23F 13/00

[52] U.S. Cl. ..... 204/196; 204/147; 204/280; 204/290 F

[58] Field of Search ..... 204/147, 196

[56] References Cited

U.S. PATENT DOCUMENTS

| | | | |
|---|---|---|---|
| 2,709,679 | 5/1955 | Andrus | 204/196 |
| 2,752,308 | 6/1956 | Andrus | 204/196 |
| 2,996,445 | 8/1961 | Eisenberg et al. | 204/196 |
| 3,056,738 | 10/1962 | Fischer | 204/196 |
| 3,133,872 | 5/1964 | Miller et al. | 204/196 |
| 3,135,677 | 6/1964 | Fischer | 204/196 |

FOREIGN PATENT DOCUMENTS

| | | | |
|---|---|---|---|
| 39-20316 | 9/1964 | Japan | 204/196 |

*Primary Examiner*—T. Tung

*Attorney, Agent, or Firm*—John A. Haug; James P. McAndrews; Melvin Sharp

[57] ABSTRACT

Protection from corrosive effects of water in hot water tanks is provided by an electrochemically active noble metal type anode disposed in the hot water tank and supplied by a selected level of current passing from the anode through the water to the tank. The anode is configured in such manner as to cause the current to be distributed throughout the entire tank according to a selected profile and takes the form of a long thin element. One portion of the anode includes a layer of noble metal clad or plated onto an electrically conductive and, under anodic conditions, chemically inert layer of metal supported on a suitable electrically insulative member.

9 Claims, 4 Drawing Figures

CORROSION PROTECTION SYSTEM FOR HOT WATER TANKS

This invention relates generally to corrosion protection of hot water tanks and more specifically to impressed current protection of such tanks.

Since hot water tanks are typically made of steel or similar corrodible material, it has become conventional to provide some type of corrosion protection for such tanks. In addition to coating the steel with glass or similar material, it is known to provide sacrificial anodes such as magnesium, zinc, and aluminum. However, such anodes suffer from certain inherent limitations. For instance, their useful life can be quite short (e.g., as little as six months), depending upon the degree of corrosivitiy of the water. Sacrificial anodes also are ineffective for protecting portions of the tank remotely located from the anode, that is, their so-called throwing power is limited. Further, in order to ensure effective protection the size and placement of the anodes must be planned for a worst case situation which results in a larger and more expensive anode system than otherwise would be required.

Attempts at providing protection utilizing impressed current techniques have been made but thus far have not been completely satisfactory. For example, as set forth in U.S. Pat. No. 4,136,001 a plurality of spaced anodes are mounted on a conductive wire in order to direct current to the entire area of the tank's interior surface. However, use of spaced, discrete anodes makes it very difficult to obtain even current distribution. Further, even if it is desired to concentrate greater current density in certain areas, the use of discrete anodes results in a profile of current density along the interior surface of the tank which in general is excessively concentrated near the discrete anodes and not sufficiently concentrated at intermediate points. In order to ensure that an acceptable minimal level of current density is provided at such intermediate points, more current than is required is produced at locations closely adjacent the anodes. Other impressed current protection approaches have involved anodes which are short lived, such as anodes of high silicon iron which are not truly electrochemically inert, have had ineffective anode configurations causing poor current distribution for a given tank or have been unsatisfactory for some other reason.

Yet another problem associated with impressed current protection of hot water tanks is related to the evolution of hydrogen occasioned by electrolysis of the water. The accumulation of hydrogen gas at the top of the tank tends to lower the water level in the tank. As shown in U.S. Pat. No. 2,752,308 one approach to deal with this is to deenegize the anode when the level of the water falls to a predetermined point. As water in the tank is used and fresh water is received in the tank the hydrogen is gradually absorbed allowing the level of water to rise so that the anode can be reenergized. A similar approach is shown in U.S. Pat. No. 3,135,677 in which a trigger wire is disposed at the top of the tank so that when it is not in contact with water in the tank due to the buildup of electrolytic gasses it will deenergize the anode to discontinue the passage of current. As a result, during those periods of time that the anode is deenergized, there is no protection of the tank from corrosivity.

It is therefore an object of the invention to provide a protection system which will effectively protect a hot water tank from corrosion on a continuous basis. Another object is to provide an impressed current protection system which has a current profile relative to the internal tank surface which results in optimum protection throughout the tank. Yet another object of the invention is the provision of an anode particularly well suited for use with an impressed current protection system for hot water tanks which is reliable, efficient, readily manufacturable and of reasonable cost.

Other objects, advantages, and details of construction of the apparatus provided by the invention appear in the following detailed description of preferred embodiments of the invention, the detailed description referring to the drawings wherein like reference characters denote like parts in the several views.

Briefly, according to the invention, an electrochemically active, non-sacrifical noble metal type anode comprises a first portion having an elongated strand of an outer layer of platinum, iridium, ruthenium, or their alloys clad or coated on a layer of electrically conductive, and, under anodic conditions, chemically inert material, such as niobium, titanium, and tantalum. This portion of the anode is helically wound on an elongated electrically insulative support which is placed within a tank extending essentially along the entire height of the tank. The pitch of the helical winding of the strand is varied along the length of the insulative support to obtain a selected current profile.

The anode also comprises a second portion having an elongated strand of a layer of electrically conductive, and under anodic conditions, chemically inert material, such as titanium, niobium, and tantalum and may be the same material as the under layer of the first portion of the anode. The first and second portions of the anode are attached to each other in any suitable manner, as by welding, at a point along the insulative support member which is lower, i.e., further from the top of the tank, than a pressure equalization hole provided in the wall of the cold water inlet conduit.

Figure 1:
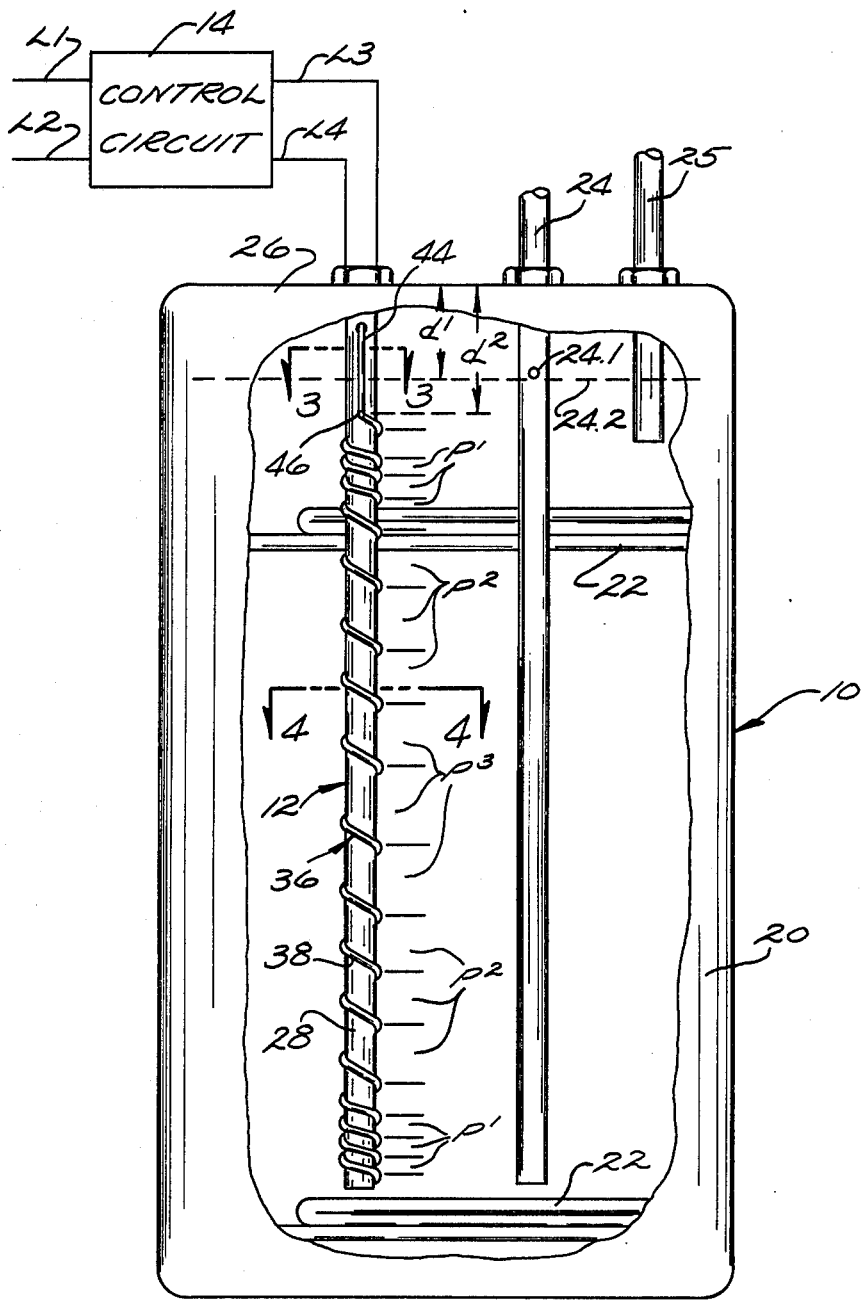
FIG. 1 is a front elevation, partly broken away, of a hot water tank incorporating an anode made in accordance with the invention.
Figure 2:
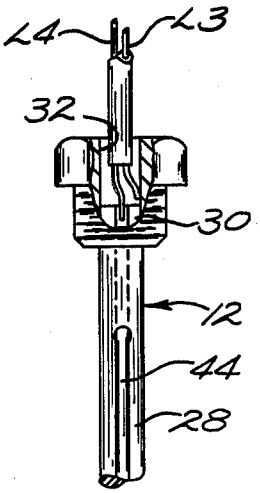
FIG. 2 is an enlarged front elevational view, also partly broken away, of a portion of the anode shown in FIG. 1.
Figure 3:
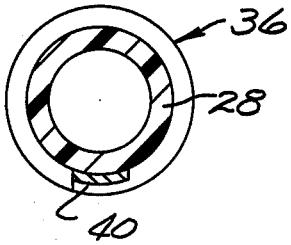
FIG. 3 is a cross sectional view taken on lines 3—3 of FIG. 1.
Figure 4:
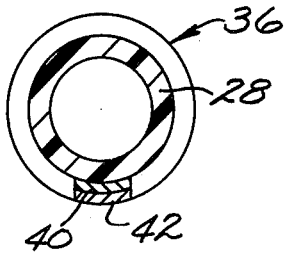
FIG. 4 is a cross sectional view taken on lines 4—4 of FIG. 1.

Turning now to the drawings, FIG. 1 shows a conventional hot water tank 10 comprising an outer wall 20 of conventional galvanically active material such as steel lined with a coating of glass or other chemically inert material. Hot water tank 10 is provided with conventional heater elements 22 connected to a suitable heater control circuit (not shown). It will be understood that the invention applies equally well to hot water tanks employing other heating means, such as gas fired heaters. A suitable water inlet 24 and outlet 25 are shown extending through a top wall 26 of the tank into its interior. A pressure equalization aperture 24.1 is formed in the wall of conduit 24 to ensure that hydrolytic gasses will not cause the level of the water to fall below dashed line 24.2 located a distance $d^1$ below the top of tank 10. Also extending through top wall 26 is an anode 12 (see also FIG. 2) comprising an elongated support member 28 of electrically insulative material, such as polypropylene having an electrically conductive threaded head portion 30 adapted to be received in a threaded bore in wall 26. Anode support member 28, is preferably cylindrical in cross section and may be solid or tubular. Member 28 extends over a major portion of the height of the tank to provide protective current to the entire interior surface of the tank. Head 30 is provided with a centrally disposed bore 32 which receives member 28 therein as well as leads L3, L4. Lead L3 is attached, as by soldering, to head 30 while lead L4 is attached to the anode element described below. Bore 32 is then potted with a conventional electrically insulating, chemically inert potting material.

A non-sacrificial anode element or strand 36 has a first portion 38 helically wound about insulative member 28 also extending over a major portion of the height of the tank. Portion 38 comprises a base layer 40 and an outer layer 42. Base layer 40 is composed of an electrically conductive, and under anodic conditions, essentially chemically inert substances, such as niobium, titanium, and tantalum. Layer 42, which may be clad to layer 40 by conventional metal cladding techniques such as solid phase roll bonding, or may be coated onto layer 40, is composed of an electrochemically active noble metal such as platinum, iridium, ruthenium, and their alloys. Anode element 36 may be maintained at its selected location on member 28 in any convenient manner as by use of spots of adhesive.

Portion 38 of anode 36 is wound about elongated support member 28 in the form of a helix having a pitch which is selected to give a particular current density in the water. As seen in FIG. 1, a first pitch $p^1$ at the top and bottom of the support member 28 results in the turns of anode 36 being quite close together producing a relatively high current density. Adjacent to the top and bottom are sections having a second, greater pitch $p^2$ resulting in turns of anode 36 which are spaced further apart producing a lower current density. In the middle of support member 28 a third pitch $p^3$ is used even greater than the $p^1$ and $p^2$ pitches resulting in turns of anode 36 which are spaced even further apart than the previous turns producing a still lower current density. The particular pitch chosen for a given location along the length of support member 28 depends upon the particular water tank which the anode is used. That is, as the geometry and materials of the tank vary, the current requirements needed for optimum corrosion protection vary. However, in many tank configurations greater current density is required near the top and bottom of the tank.

Anode 36 is formed with a second portion 44 which is composed of a layer of an electrically conductive, and under anodic conditions, essentially chemically inert substance, such as niobium, titanium, and tantalum used for base layer 40. Preferably, portion 44 is formed of the same material as base layer 40 of portion 38. Second portion 44 has one end attached to lead L4 and its opposite end attached to anode portion 38 at 46 in any conventional manner, as by welding. The location of the point of attachment 46 of portions 38 and 44 is chosen so that it is below pressure equalization aperture 24.1 at a distance $d^2$ from the top of tank 10 so that chemically active layer 42 is always inundated and is not exposed to the electrolytic gasses.

The specific dimensions selected for strands 38 and 40 are selected to provide adequate current for the surfaces to be protected and thus depend on the size and configuration of the particular tank being protected. In general, in a system in which niobium is employed for the base strand 40, a thickness of 0.001 to 0.050 inch is suitable with 0.010 to 0.015 inch being optimum for most applications. With platinum used for strand 42 a thickness of 10 to 250 microinches is suitable with an optimum of approximately 25 microinches for most applications. For the above thickness a width of 0.020 inch has been found to be suitable.

For a typical forty gallon tank approximately 1 foot in diameter with a height of 5 feet, the pressure equalization aperture is disposed at a distance $d^1$ of approximately six inches. The length of portion 44 is selected so that connection 46 is disposed at a distance $d^2$ of approximately eight inches to insure that noble layer 42 is never exposed to electrolytic gasses accumulated at the top of the tank.

Control circuit 14 which may be any conventional control circuit but preferably is one which will provide at least a minimum desired current level for effective corrosion protection of tank 10 is connected to any suitable current source via lines L1, L2. One suitable control circuit which provides regulation of the level of protective current based on the particular level of water corrosivity is set forth in copending application, Ser. No. 270,945, assigned to the assignee of the instant invention to which reference may be made for further details.

It should be understood that although the particular embodiment of the invention has been described by way of illustration, this invention includes all modifications and equivalents of the disclosed embodiment falling within the scope of the appended claims.

We claim:

1. In a hot water tank comprising, a substantially hollow metal tank having a selected height and an interior surface, the tank being formed at least in part of a corrosively active material, a non-sacrificial anode mounted in the tank and adapted to direct an electrically positive current therefrom to the interior surface when the tank is full of water, an elongated electrically insulative member having first and second end portions, the anode comprising an elongated, electrically conductive member having a portion wound helically about the insulative member from the first to the second end, the helical winding having a smaller pitch adjacent the first and second ends than the pitch intermediate the ends of the insulative member.

2. In a hot water tank comprising, a substantially hollow metal tank having a selected height and an interior surface, the tank being formed at least in part of a corrosively active material, a non-sacrificial anode mounted in the tank and adapted to direct an electrically positive current therefrom to the interior surface when the tank is full of water, an elongated electrically insulative member having first and second end portions, the anode comprising an elongated, electrically conductive member having a portion wound helically about the insulative member from the first end to the second end, the helical winding having a pitch which is non-uniform along the length of the insulative member whereby a desired current density profile along the interior surface of the tank is produced.

3. Apparatus according to claim 2 in which the portion of the anode wound about the electrically insulative member comprises at least two metal layers substantially coextensive in length, the first layer composed of an electrically conductive and under anodic conditions, essentially chemically inert material, the second layer composed of an electrochemically active noble metal, and the anode includes a second portion composed of a layer of an electrically conductive and under anodic conditions, essentially chemically inert material.

4. Apparatus according to claim 3 in which an inlet water conduit extends into the tank over a major portion of the height of the tank, the conduit having an open end disposed adjacent the bottom of the tank, an aperture extends through the side wall of the conduit at a selected distance $d^1$ from the top of the tank to allow equalization of pressure, the first portion of anode connected to the second portion of the anode at a point located at a distance $d^2$ from the top of the tank, $d^2$ being greater than $d^1$.

5. Apparatus according to claim 3 in which the electrically conductive and under anodic conditions, essentially chemically inert material is the same in both the first and second portion of the anode.

6. Apparatus according to claim 5, in which the electrically conductive and under anodic conditions, essentially chemically inert material is selected from the group consisting of titanium, tantalum, and niobium.

7. Apparatus according to claim 5 in which the electrically conductive and under anodic conditions, essentially chemically inert material is niobium.

8. Apparatus according to claim 3 in which the first layer of the first portion and the layer of the second portion is selected from the group consisting of titanium, tantalum, and niobium.

9. Apparatus according to claim 3 in which the second layer is selected from the group consisting of platinum, iridium, ruthenium, and their alloys.

* * * * *